US012653242B2

(12) United States Patent
Wang

(10) Patent No.: US 12,653,242 B2
(45) Date of Patent: Jun. 16, 2026

(54) VAPORIZATION DEVICE AND SUCTION NOZZLE ASSEMBLY THEREOF

(71) Applicant: Shenzhen Verdewell Technology Limited, Shenzhen (CN)

(72) Inventor: Tao Wang, Shenzhen (CN)

(73) Assignee: Shenzhen Verdewell Technology Limited, Shenzhen (CN)

( * ) Notice: Subject to any disclaimer, the term of this patent is extended or adjusted under 35 U.S.C. 154(b) by 522 days.

(21) Appl. No.: 17/842,239

(22) Filed: Jun. 16, 2022

(65) Prior Publication Data

US 2022/0400762 A1 Dec. 22, 2022

(30) Foreign Application Priority Data

Jun. 21, 2021 (CN) ..... 202121386567.9

(51) Int. Cl.

| | |
|---|---|
| ***A24F 7/00*** | (2006.01) |
| ***A24F 40/20*** | (2020.01) |
| ***A24F 40/40*** | (2020.01) |
| ***A24F 40/46*** | (2020.01) |
| ***A24F 40/485*** | (2020.01) |

(52) U.S. Cl.

CPC ..... *A24F 40/485* (2020.01); *A24F 40/20* (2020.01); *A24F 40/46* (2020.01)

(58) Field of Classification Search

None

See application file for complete search history.

(56) References Cited

U.S. PATENT DOCUMENTS

| | | | |
|---|---|---|---|
| 1,118,276 A | 11/1914 | Fredericks | |
| 3,791,390 A | 2/1974 | Hendricks | |

(Continued)

FOREIGN PATENT DOCUMENTS

| | | | | |
|---|---|---|---|---|
| CN | 103717098 A | | 4/2014 | |
| CN | 108260855 A | | 7/2018 | |
| CN | 109793279 A | | 5/2019 | |
| CN | 210869884 U | | 6/2020 | |
| CN | 112021679 A | | 12/2020 | |
| CN | 112401313 A | * | 2/2021 | ..... A24F 40/40 |

(Continued)

OTHER PUBLICATIONS

English translation of CN109793279A (Year: 2019).*

(Continued)

*Primary Examiner* — Philip Y Louie
*Assistant Examiner* — Vu P Pham
(74) *Attorney, Agent, or Firm* — Leydig, Voit & Mayer, Ltd.

(57) ABSTRACT

A suction nozzle assembly includes: a suction nozzle base provided with an air guide channel and a suction nozzle mounted on the suction nozzle base, the suction nozzle having a rotation shaft portion and a suction nozzle portion transversely extending from the rotation shaft portion, a rotation central axis of the rotation shaft portion being disposed in a biased manner relative to a central axis of the suction nozzle base and a central axis of the suction nozzle portion respectively, the suction nozzle portion forming an air suction channel communicating the air guide channel with outside air, and the air suction channel including an air suction end away from the rotation shaft portion. The suction nozzle portion transversely rotates around the rotation shaft portion between a first position and a second position relative to the suction nozzle base.

20 Claims, 11 Drawing Sheets

(56) References Cited

U.S. PATENT DOCUMENTS

| | | | | |
|---|---|---|---|---|
| 2016/0157520 | A1* | 6/2016 | Alfawaz | A24F 1/30 131/226 |
| 2016/0249677 | A1 | 9/2016 | Bishara | |
| 2018/0199630 | A1* | 7/2018 | Qiu | A61M 15/06 |
| 2018/0283457 | A1* | 10/2018 | Plioska | B60N 2/933 |
| 2019/0069606 | A1* | 3/2019 | Qiu | A24F 40/40 |
| 2019/0090543 | A1 | 3/2019 | Qiu et al. | |
| 2019/0269177 | A1* | 9/2019 | Liu | A24F 40/00 |
| 2020/0305504 | A1 | 10/2020 | Chen et al. | |
| 2020/0345070 | A1 | 11/2020 | Ding | |
| 2022/0183380 | A1* | 6/2022 | Yang | A24F 40/10 |

FOREIGN PATENT DOCUMENTS

| | | | |
|---|---|---|---|
| CN | 112545063 | A | 3/2021 |
| CN | 213335377 | U | 6/2021 |
| CN | 217958767 | U | 12/2022 |
| DE | 202021001014 | U1 | 5/2021 |
| WO | 2017190650 | A1 | 11/2017 |
| WO | 2018112769 | A1 | 6/2018 |
| WO | 2018133097 | A1 | 7/2018 |
| WO | 2018195902 | A1 | 11/2018 |
| WO | 2018223563 | A1 | 12/2018 |
| WO | 2019047204 | A1 | 3/2019 |
| WO | 2019051706 | A1 | 3/2019 |
| WO | 2019170886 | A1 | 9/2019 |
| WO | 2020000869 | A1 | 1/2020 |
| WO | 2020134767 | A1 | 7/2020 |
| WO | 2020228800 | A1 | 11/2020 |
| WO | 2021102839 | A1 | 6/2021 |

OTHER PUBLICATIONS

English Translation of CN112401313A (Year: 2021).*

Patent Cooperation Treaty, International Search Report and Written Opinion, International Application No. PCT/CN2021/101297 (Mar. 1, 2022).

Canadian Intellectual Property Office, Office Action in Canadian Patent Application No. 3,164,683 (Jun. 27, 2024).

U.S. Patent and Trademark Office, Office Action in U.S. Appl. No. 17/842,198 (Sep. 6, 2024).

Chinese Patent Office, Office Action in Chinese Patent Application No. 202110688344.6 (Jul. 22, 2024).

Canadian Intellectual Property Office, First Office Action in Canadian Patent Application No. 3,164,680 (Sep. 13, 2023).

Canadian Intellectual Property Office, First Office Action in Canadian Patent Application No. 3,164,683 (Oct. 6, 2023).

Chinese Patent Office, First Notification to Rectification in Chinese Patent Application No. 202121385323.9 (Dec. 16, 2021).

Chinese Patent Office, Notice of Registration and Notification to Grant Patent Right in Chinese Patent Application No. 202121385322.4 (Jan. 10, 2022).

Chinese Patent Office, Notice of Registration and Notification to Grant Patent Right in Chinese Patent Application No. 202121384958.7 (Dec. 16, 2021).

Chinese Patent Office, Notice of Registration and Notification to Grant Patent Right in Chinese Patent Application No. 202121386567.9 (Dec. 15, 2021).

Patent Cooperation Treaty, International Search Report, International Application No. PCT/CN2021/101297 (Mar. 1, 2022).

Patent Cooperation Treaty, Written Opinion of the International Searching Authority, International Application No. PCT/CN2021/101297 (Mar. 1, 2022).

Canadian Patent Office, Office Action in Canadian Patent Application No. 3,164,683 (Mar. 24, 2025).

Chinese Patent Office, Notification of grant of patent right for invention in Chinese Patent Application No. 202110688344.6 (May 23, 2025).

U.S. Patent and Trademark Office, Office Action in U.S. Appl. No. 17/842,198 (May 5, 2025).

U.S. Patent and Trademark Office, Office Action in U.S. Appl. No. 17/842,198 (Oct. 2, 2025).

U.S. Patent and Trademark Office, Office Action in U.S. Appl. No. 17/842,198 (Jan. 30, 2026).

* cited by examiner

VAPORIZATION DEVICE AND SUCTION NOZZLE ASSEMBLY THEREOF

CROSS-REFERENCE TO PRIOR APPLICATION

Priority is claimed to Chinese Patent Application No. CN 202121386567.9, filed on Jun. 21, 2021, the entire disclosure of which is hereby incorporated by reference herein.

FIELD

The present disclosure relates to the field of vaporization, and more specifically, to a vaporization device and a suction nozzle assembly thereof.

BACKGROUND

A vaporization device is a device configured to heat a vaporization medium such as plant tobacco leaves or opium paste to generate vapor for a user to inhale. The vaporization device generally includes a heating assembly configured to heat a vaporization medium to produce vapor after energized and a suction nozzle assembly configured to guide out the vapor. If an air output path of the suction nozzle assembly is excessively short, an air temperature during outputting of the vapor is relatively high, leading to poor user experience; and if the air output path is excessively long, a space occupied by the vaporization device is relatively great, which is not conducive to accommodation and carrying.

SUMMARY

In an embodiment, the present invention provides a suction nozzle assembly, comprising: a suction nozzle base provided with an air guide channel and a suction nozzle mounted on the suction nozzle base, the suction nozzle comprising a rotation shaft portion and a suction nozzle portion transversely extending from the rotation shaft portion, a rotation central axis of the rotation shaft portion being disposed in a biased manner relative to a central axis of the suction nozzle base and a central axis of the suction nozzle portion respectively, the suction nozzle portion forming an air suction channel communicating the air guide channel with outside air, and the air suction channel comprising an air suction end away from the rotation shaft portion, wherein the suction nozzle portion is configured to transversely rotate around the rotation shaft portion between a first position and a second position relative to the suction nozzle base, and wherein, when the air suction channel is at the second position, the air suction end of the air suction channel protrudes out of the suction nozzle base.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
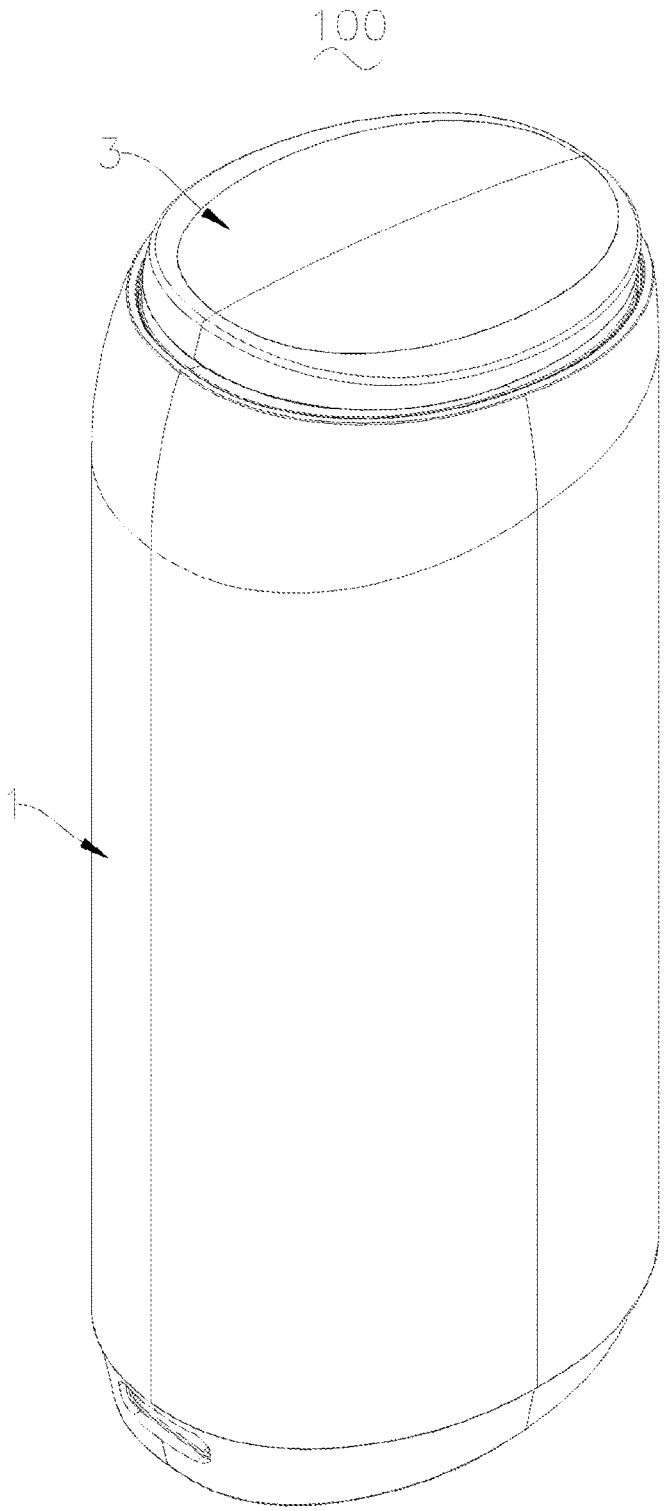
FIG. 1 is a three-dimensional schematic structural diagram of a vaporization device with a suction nozzle at a first position according to a first embodiment of the present disclosure.
Figure 2:
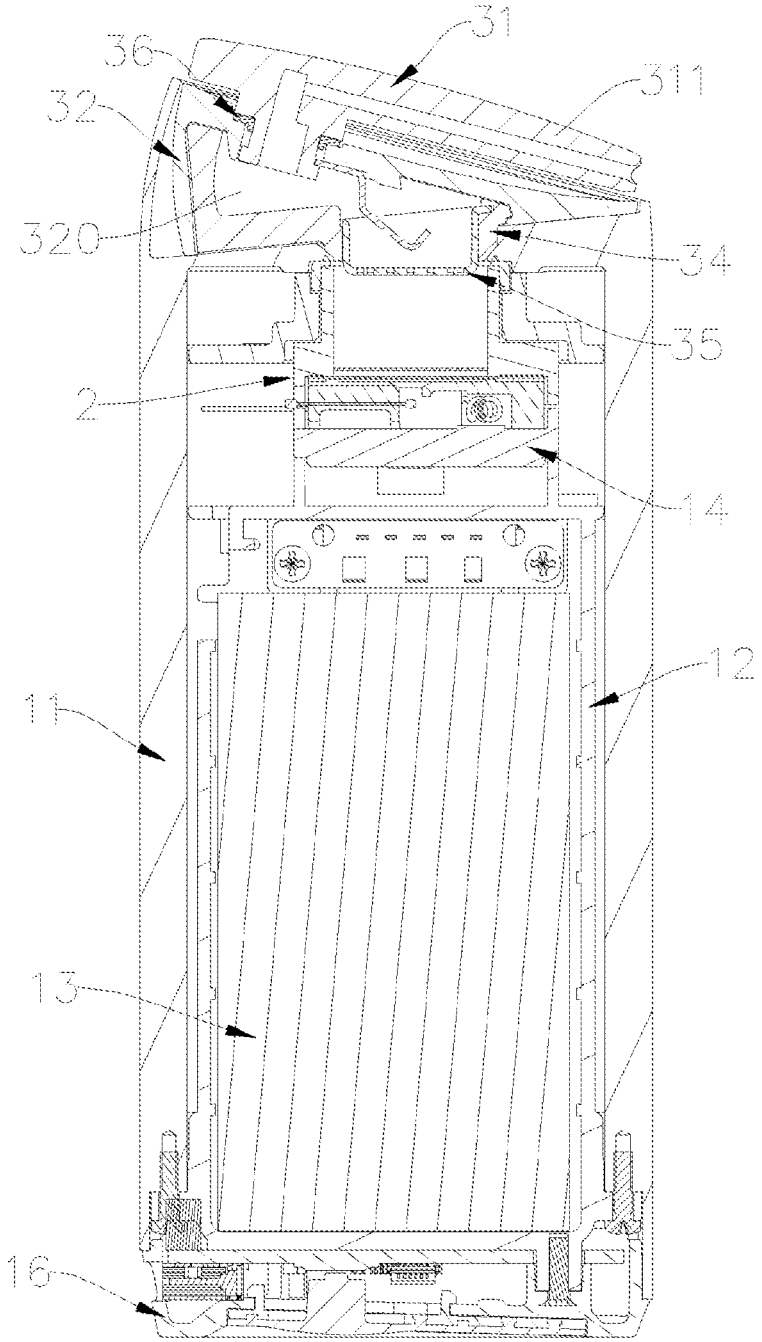
FIG. 2 is a schematic structural cross-sectional view of the vaporization device shown in FIG. 1.
Figure 3:
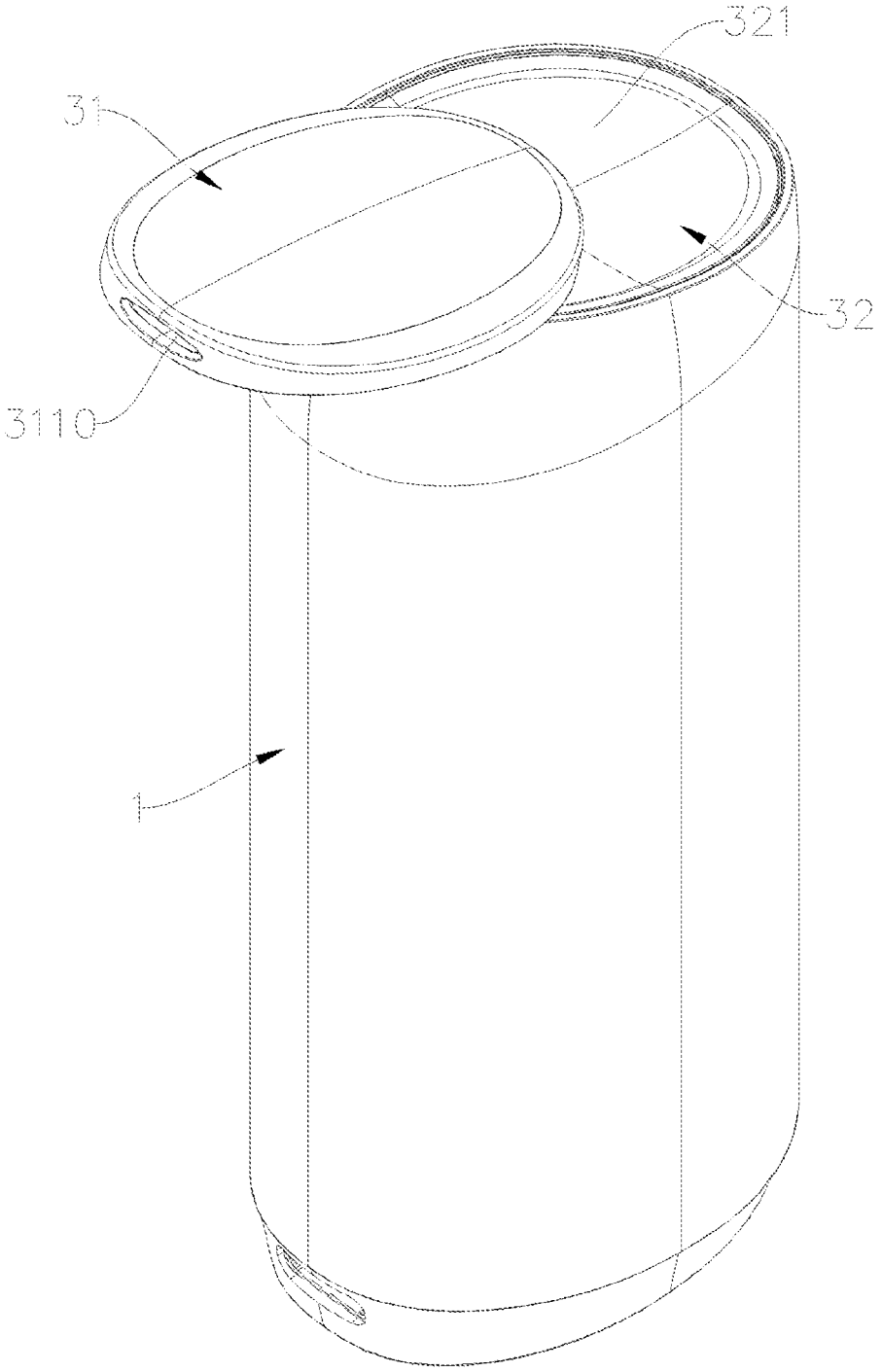
FIG. 3 is a three-dimensional schematic structural diagram of the vaporization device in FIG. 1 with the suction nozzle at a second position.
Figure 4:
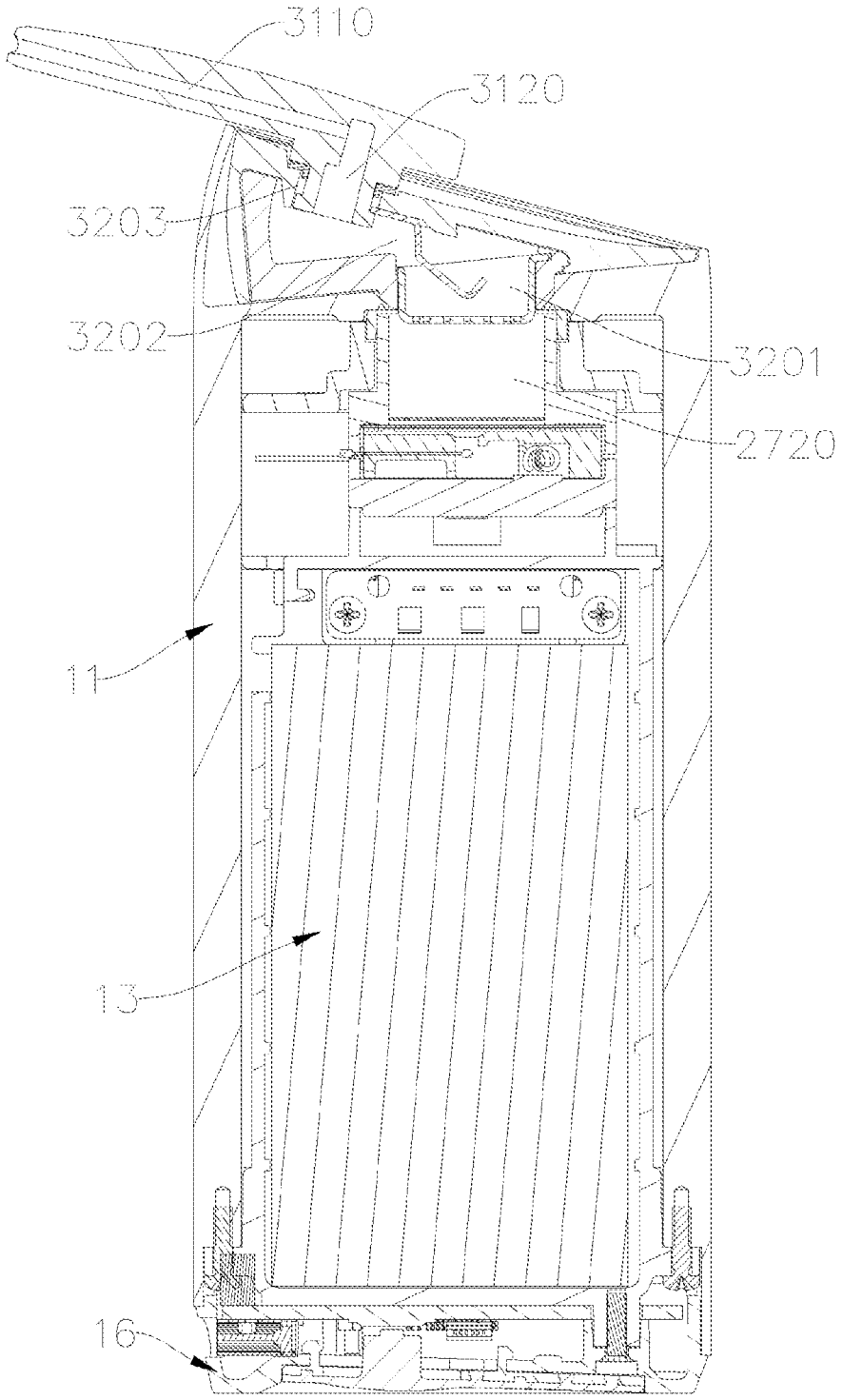
FIG. 4 is a schematic structural cross-sectional view of the vaporization device shown in FIG. 3.
Figure 5:
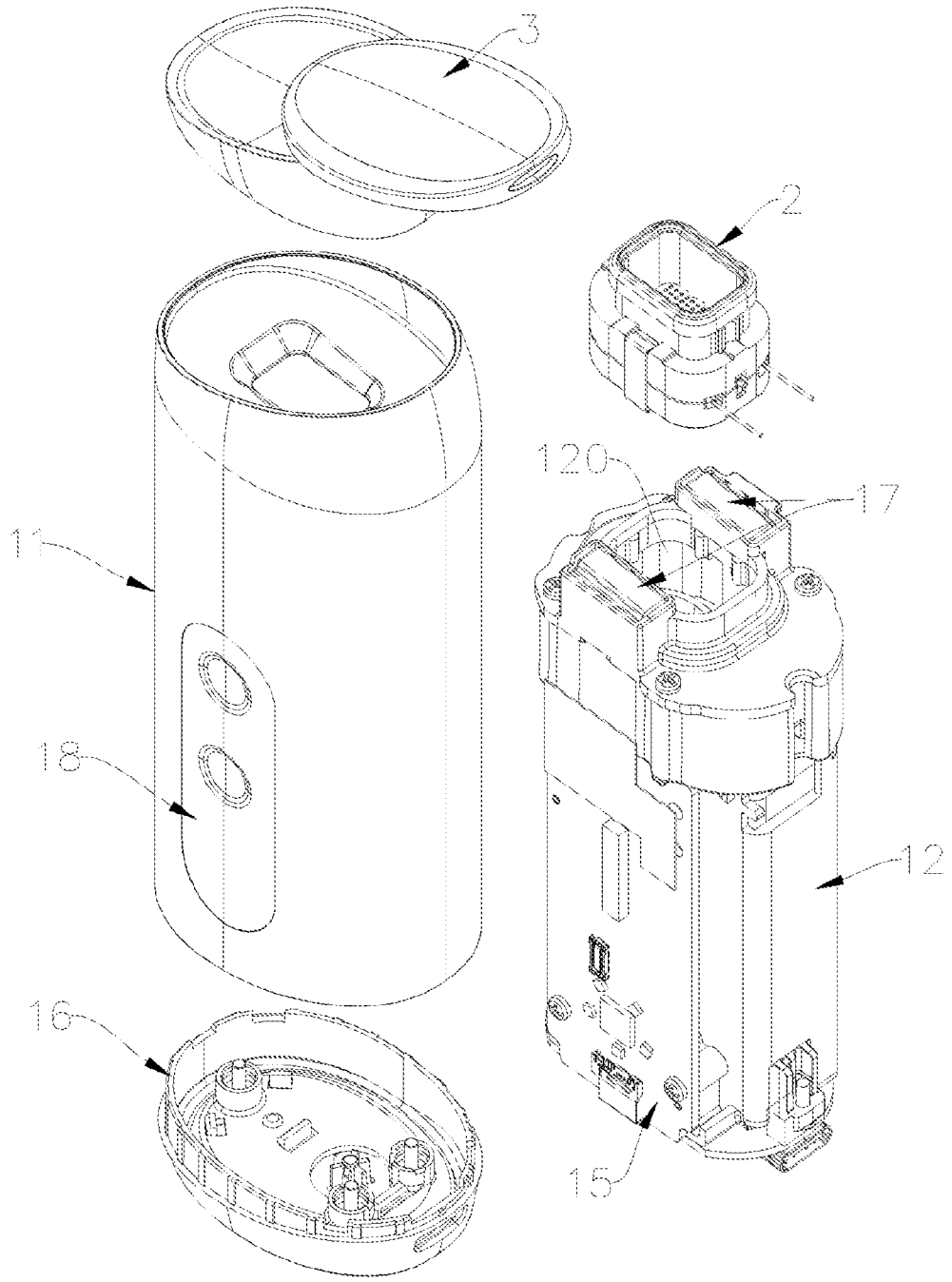
FIG. 5 is a schematic structural exploded view of the vaporization device shown in FIG. 3.
Figure 6:
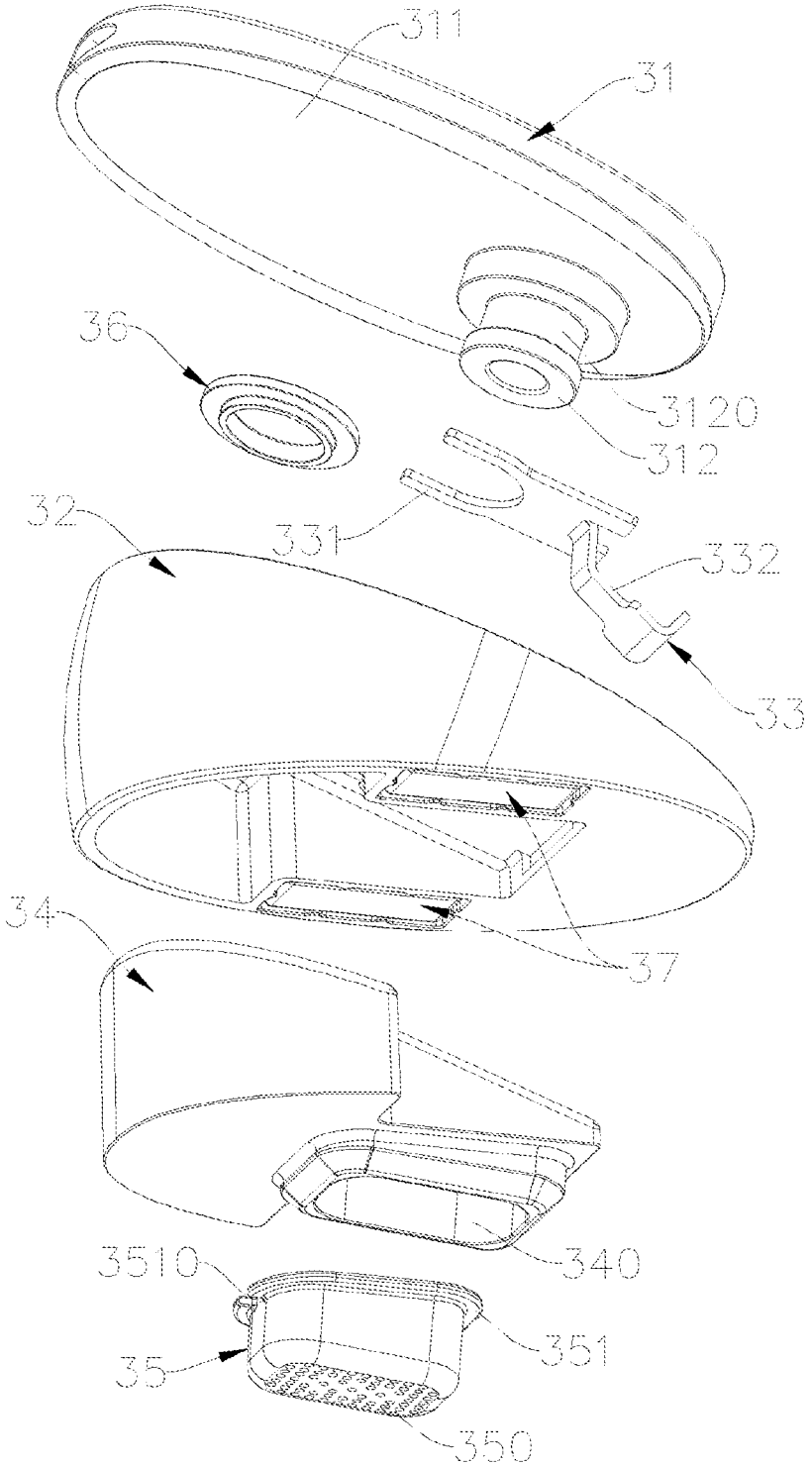
FIG. 6 is a schematic structural exploded view of a suction nozzle assembly in FIG. 5.

In an embodiment, the present invention provides an improved suction nozzle assembly and a vaporization device including the suction nozzle assembly for the foregoing defects in the related art.

In an embodiment, the present invention provides a suction nozzle assembly, including a suction nozzle base provided with an air guide channel and a suction nozzle mounted on the suction nozzle base, where the suction nozzle includes a rotation shaft portion and a suction nozzle portion transversely extending out from the rotation shaft portion, a rotation central axis of the rotation shaft portion is disposed in a bias manner relative to a central axis of the suction nozzle base and a central axis of the suction nozzle portion respectively, the suction nozzle portion forms an air suction channel communicating the air guide channel with the outside, and the air suction channel includes an air suction end away from the rotation shaft portion; and the suction nozzle portion is configured to transversely rotate around the rotation shaft portion between a first position and a second position relative to the suction nozzle base, and when the air suction channel is at the second position, the air suction end of the air suction channel protrudes out of the suction nozzle base.

In some embodiments, when the air suction channel is at the first position, the air suction end of the air suction channel is retracted to the suction nozzle base.

In some embodiments, when the air suction channel is at the second position, a position of the air suction end of the air suction channel is higher than the suction nozzle base.

In some embodiments, an extending direction of the air suction channel is parallel to or form a set angle with a horizontal direction.

In some embodiments, the air suction channel is capable of rotating by 360 degrees around the rotation shaft portion.

In some embodiments, the suction nozzle is detachably mounted on the suction nozzle base.

In some embodiments, the air suction channel extends in a length direction of the suction nozzle portion.

In some embodiments, the suction nozzle base includes a mounting plane configured to mount the suction nozzle portion; the air guide channel includes a first air guide channel extending upward from a bottom surface of the suction nozzle base, a third air guide channel extending downward from the mounting plane, and a second air guide channel communicating the first air guide channel with the third air guide channel; and the rotation shaft portion is rotatably disposed in the third air guide channel.

In some embodiments, the suction nozzle assembly further includes a clasp member, and the clasp member is detachably clamped on the rotation shaft portion, to define an axial position of the rotation shaft portion in the third air guide channel.

In some embodiments, a fasten groove is formed on the rotation shaft portion, the clasp member includes an opening ring, and the opening ring is detachably clamped in the fasten groove and clamped between a lower end surface of the third air guide channel and a lower end surface of the fasten groove.

In some embodiments, the clasp member further includes an extending portion extending from one side of the opening ring away from the rotation shaft portion.

In some embodiments, the suction nozzle assembly further includes a filter mesh disposed in the first air guide channel, and a plurality of filter holes for airflow to run through are distributed on the filter mesh.

In some embodiments, the suction nozzle assembly further includes a seal ring sealedly disposed between an outer wall surface of the filter mesh and an inner wall surface of the first air guide channel.

In some embodiments, the suction nozzle assembly further includes at least one first magnetic member embedded in a bottom of the suction nozzle base.

The present disclosure further provides a vaporization device, including a body and the suction nozzle assembly according to any one of the foregoing disposed in the body.

In some embodiments, the suction nozzle assembly is detachably disposed on the body.

In some embodiments, the suction nozzle assembly is magnetically connected to the body.

In some embodiments, the vaporization device further includes a heating assembly disposed in the body and in air communication with the air guide channel, and the heating assembly includes a heating body and a shunt mesh disposed on the heating body.

In some embodiments, a convergence hole is formed on the heating body, a diffusion cavity communicating the convergence hole with the air guide channel is formed between the heating body and the shunt mesh, the shunt mesh includes a shunt region disposed corresponding to the diffusion cavity, and a plurality of airflow holes for airflow to run through are distributed on the shunt region.

In some embodiments, the shunt region includes a center region located at a center and a peripheral region surrounding the center region, and a distribution density of the plurality of airflow holes in the center region is less than a distribution density in the peripheral region.

In some embodiments, the heating assembly further includes a replaceable filter mesh disposed above the shunt mesh and configured to place a vaporization medium; and the replaceable filter mesh includes a bottom wall, and a plurality of first filter holes for airflow to run through are distributed on the bottom wall.

In some embodiments, the replaceable filter mesh includes a first region located at a center and a second region surrounding the first region, and a distribution density of the plurality of first filter holes in the first region is less than a distribution density in the second region.

In some embodiments, a vent gap is formed between the replaceable filter mesh and the shunt mesh. In some embodiments, the heating assembly further includes a paste guide body disposed above the shunt mesh and configured to place a paste vaporization medium.

Implementation of the present disclosure at least has the following beneficial effects: according to this structure configuration of the suction nozzle assembly, an air output path of the vapor can be greatly extended, so that an air temperature when the vapor is output is greatly reduced, and the space occupied by the vaporization device may be relatively small, thereby facilitating accommodating and carrying of the vaporization device.

To have a clearer understanding of the technical features, objectives, and effects of the present disclosure, specific implementations of the present disclosure are described in detail with reference to the accompanying drawings.

FIG. 1 to FIG. 9 show a vaporization device 100 according to a first embodiment of the present disclosure. The vaporization device 100 may be approximately in a shape of an elliptical cylinder and may include a body 1, a suction nozzle assembly 3 longitudinally disposed above the body 1, and a heating assembly 2 disposed in the body 1. The suction nozzle assembly 3 may be detachably mounted above the body 1, to help dismount the suction nozzle assembly 3 from the body 1 for cleaning, and a vaporization medium may be added to the heating assembly 2 after the suction nozzle assembly 3 is dismounted. The heating assembly 2 may generate heat after energized to heat air into hot air, the hot air flows to the vaporization medium to heat and vaporize the vaporization medium into vapor, and the vapor flows out through the suction nozzle assembly 3 for a user to inhale. It may be understood that, the vaporization device 100 is not limited to the shape of an elliptical cylinder, and may alternatively in another shape such as a shape of a cylinder, a square cylinder, or a flat cylinder.

In some embodiments, the body 1 may include a cylindrical shell 11, a button 18 disposed on the shell 11, a bottom cover 16 disposed below the shell 11, a battery 13 disposed in the shell 11, and a main board 15 disposed in the shell 11. The battery 13 is electrically connected to the main board 15, the main board 15 is electrically connected to the heating assembly 2, and the main board 15 may control on/off between the battery 13 and the heating assembly 2 under action of the button 18.

In some embodiments, the body 1 may further include a holder 12 longitudinally disposed in the shell 11. The battery 13 may be disposed in the holder 12, and the main board 15 may be disposed on one side of the holder 12. An upper portion of the holder 12 forms an accommodating groove 120 with a top opening, and the heating assembly 2 may be placed in the accommodating groove 120 through the top opening. The accommodating groove 120 may be provided with a thermal insulation pad 14, and the heating assembly 2 may abut against a bottom wall of the accommodating groove 120 through the thermal insulation pad 14, which helps improve the thermal insulation performance between the heating assembly 2 and the holder 12. The thermal insulation pad 14 may be generally made of a material with high temperature resistance and low thermal conductivity such as thermal insulation cotton. A top portion of the body 1 may be further provided with at least one magnetic member 17 configured to magnetically connected to the suction nozzle assembly 3. In this embodiment, there are two magnetic members 17, and the two magnetic members 17 may be embedded in a top portion of the holder 12 and respectively located on two opposite sides of the accommodating groove 120.

As shown in FIG. 2 to FIG. 6, in some embodiments, the suction nozzle assembly 3 may include a suction nozzle base 32 and a suction nozzle 31 rotatably disposed on the suction nozzle base 32. The suction nozzle base 32 includes an air guide channel 320 in air communication with the heating assembly 2, and the suction nozzle 31 includes a rotation shaft portion 312 rotatably disposed on the suction nozzle base 32 and a suction nozzle portion 311 transversely extending out from the rotation shaft portion 312. A rotation central axis of the rotation shaft portion 312 is disposed in a bias manner relative to a central axis of the suction nozzle portion 311 and a central axis of the suction nozzle base 32 respectively. An air suction channel 3110 is formed on the suction nozzle portion 311, and the air suction channel 3110 communicates the air guide channel 320 with the outside, to guide vapor generated after vaporization of the heating assembly 2 out for a user to inhale. The air suction channel 3110 includes an air suction end away from the rotation shaft portion 312, and the suction nozzle portion 311 can transversely rotate around the rotation shaft portion 312 between a first position and a second position relative to the suction nozzle base 32. When the air suction channel 3110 is at the first position, the air suction end of the air suction channel 3110 is retracted to the suction nozzle base 32; and when the air suction channel 3110 is at the second position, the air suction end of the air suction channel 3110 protrudes out of the suction nozzle base 32.

In some embodiments, the air guide channel 320 may include a first air guide channel 3201, a second air guide channel 3202, and a third air guide channel 3203 communicated with each other from bottom to top. The first air guide channel 3201 may be formed through rightly upward extension of a bottom surface of the suction nozzle base 32, and may be disposed coaxially with the body 1 and the heating assembly 2. A top position of the suction nozzle base 32 includes a mounting plane 321, the third air guide channel 3203 may be formed through downward extension of the mounting plane 321, and a central axis of the third air guide channel 3203 is disposed in a bias manner relative to a central axis of the first air guide channel 3201. In this embodiment, the mounting plane 321 is a slope and forms a certain angle with a horizontal plane, an extending direction of the third air guide channel 3203 is perpendicular to the mounting plane 321 and forms a certain angle with a vertical direction, and the third air guide channel 3203 is disposed on a relatively high side of the mounting plane 321. In other embodiments, the mounting plane 321 may be alternatively parallel to the horizontal plane, and the extending direction of the third air guide channel 3203 may be alternatively parallel to the vertical direction.

The rotation shaft portion 312 may be rotatably disposed in the third air guide channel 3203. An airflow channel 3120 in communication with the air guide channel 320 is formed on the rotation shaft portion 312, and the airflow channel 3120 may be disposed coaxially with the third air guide channel 3203. The air guide channel 320, the airflow channel 3120, and the air suction channel 3110 are communicated with each other sequentially, to form an air outlet channel for guiding vapor out. The suction nozzle portion 311 is approximately in a shape of an elliptical sheet and the air suction channel 3110 in communication with the airflow channel 3120 is formed in a length direction of the suction nozzle portion. The suction nozzle portion 311 is mounted on the mounting plane 321 and may transversely rotate by 360 degrees in a plane overlapping with or parallel to the mounting plane 321. When the suction nozzle portion 311 is at the first position, the suction nozzle portion 311 is retracted to the suction nozzle base 32, an outer edge of the suction nozzle portion 311 overlaps or approximately overlaps with an outer edge of the mounting plane 321, which can greatly reduce a space occupied by the vaporization device and facilitates accommodation and carrying. When the suction nozzle portion 311 is at the second position, the air suction end of the suction nozzle portion 311 protrudes out of the suction nozzle base 32 and extends oblique upward to facilitate a user to inhale through mouth. According to this structure configuration of the suction nozzle assembly, a path of the air outlet channel of the vapor can be greatly extended, so that an air temperature when the vapor is output is greatly reduced, and the space occupied by the vaporization device may be relatively small.

In some embodiments, the suction nozzle assembly 3 may further include a filter mesh 35 disposed in the first air guide channel 3201, a seal sleeve 34 sealedly disposed between an outer wall surface of the filter mesh 35 and an inner wall surface of the first air guide channel 3201, a clasp member 33 detachably clamped on the rotation shaft portion 312, a seal ring 36 sealedly sleeved on the rotation shaft portion 312, and at least one magnetic member 37 embedded in a bottom of the suction nozzle base 32.

The filter mesh 35 may be in a shape of a bowl and may be made of a metal material such as stainless steel. The filter mesh 35 may filter out impurities doped in the vapor, to prevent the impurities from being inhaled in a mouth of the user, thereby improving the user experience. A bottom wall of the filter mesh 35 is provided with a plurality of filter holes 350 for airflow to run through, and the vapor generated through vaporization of the heating assembly 2 enters the air guide channel 320 through the filter holes 350. An upper periphery of the filter mesh 35 may protrude outward to form an annular positioning flange 351, and the positioning flange 351 may abut against an upper end of the first air guide channel 3201. An outer edge of the positioning flange 351 may concave inward to form at least one groove 3510, so that the user may take out the filter mesh 35 by using tools such as a nipper.

The seal sleeve 34 is embedded in a lower portion of the suction nozzle base 32 and may be made of an elastic material such as silica gel. A bottom surface of the seal sleeve 34 extends upward to form a vent groove 340, an inner wall surface of the vent groove 340 defines the first air guide channel 3201, and the filter mesh 35 is tightly embedded in the vent groove 340. The magnetic member 37 is configured to be magnetically connected to the body 1. In this embodiment, there are two magnetic members 37 and are respectively disposed on two sides of the first air guide channel 3201, and the two magnetic members 37 are disposed with the two magnetic members 17 in a one-to-one correspondence and magnetically connected to each other respectively.

A fasten groove 3120 is formed on the rotation shaft portion 312, and the clasp member 33 is detachably clamped in the fasten groove 3120 to implement fast mounting and dismounting of the suction nozzle base 32 and the suction nozzle 31. The clasp member 33 may include an opening ring 331 and an extending portion 332 connected to the opening ring 331. The fasten groove 3120 may be in a shape of a circle and is formed by the outer periphery of the rotation shaft portion 312 concaving inward in a radial direction. The opening ring 331 is clamped in the circular fasten groove 3120, an upper end surface of the opening ring 331 abuts against a lower end surface of the third air guide channel 3203, and a lower end surface of the opening ring 331 abuts against a lower end surface of the ring-shaped fasten groove 3120. The extending portion 332 may be formed by one side away from an opening of the opening ring 331 through bending obliquely downward, and the extending portion 332 may facilitate the user to manually mount and dismount the clasp member 33. When the suction nozzle assembly 3 is dismounted, the seal sleeve 34 may be taken out from the below of the suction nozzle base 32, the filter mesh 35 is then dismounted from the seal sleeve 34, the clasp member 33 is dismounted from the rotation shaft portion 312, and the suction nozzle 31 is dismounted from the above of the suction nozzle base 32. The structure design of the suction nozzle assembly enables the suction nozzle assembly to be dismounted into components conveniently, so that oil stains and dust accumulated after inhalation of the components can be immersed (such as ethanol) and cleaned.

The seal ring 36 may be in a shape of a circle and sleeved in the circular fasten groove 3120, an upper end surface of the seal ring 36 abuts against an upper end surface of the circular fasten groove 3120, and a lower end surface of the seal ring 36 abuts against an upper end surface of the third air guide channel 3203. The seal ring 36 may be made of an elastic material such as silica gel and work with the clasp member 33 to implement axial direction positioning of the rotation shaft portion 312 in the third air guide channel 3203.

Figure 7:
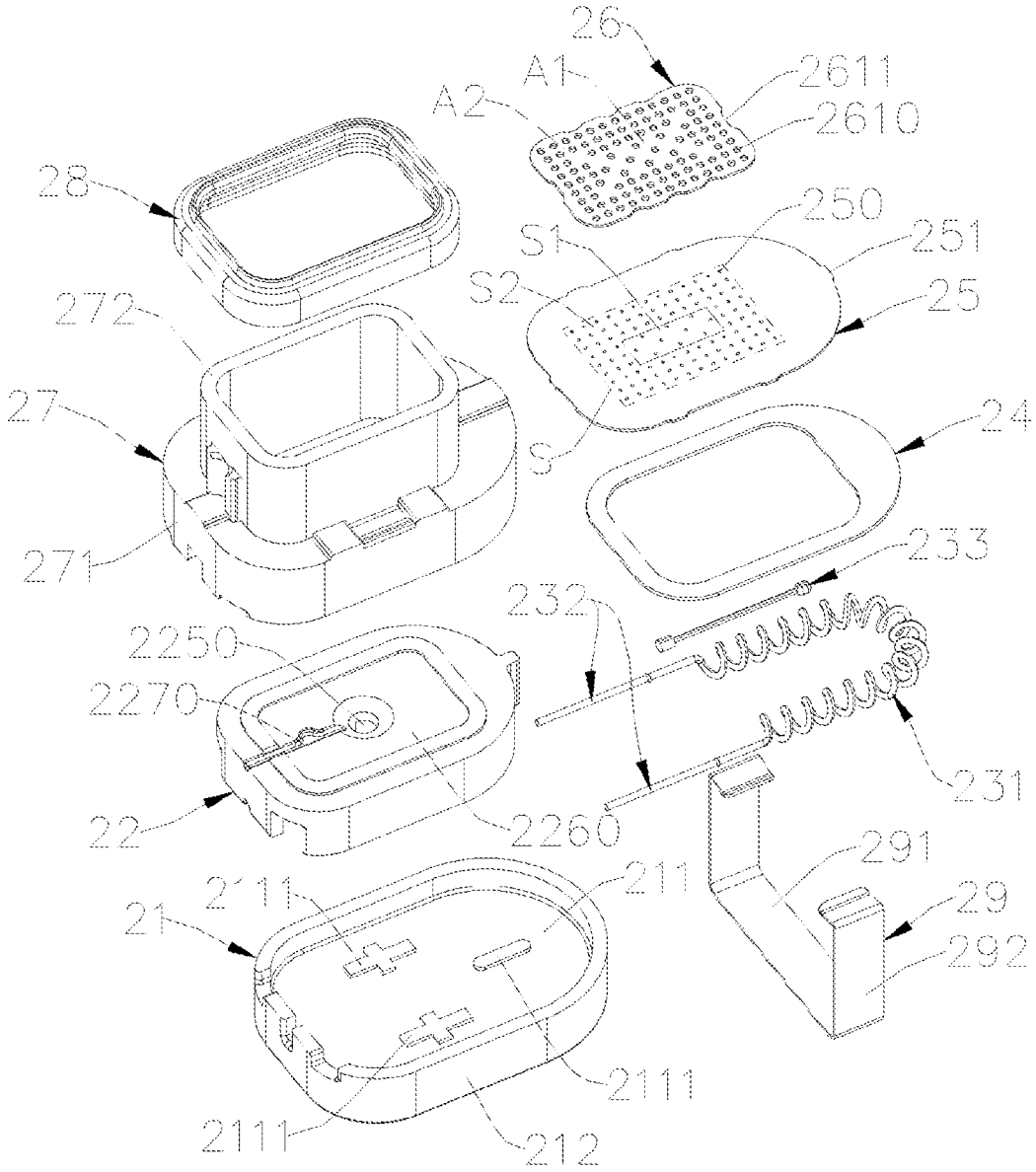
FIG. 7 is a schematic structural exploded view of a heating assembly in FIG. 5.
Figure 8:
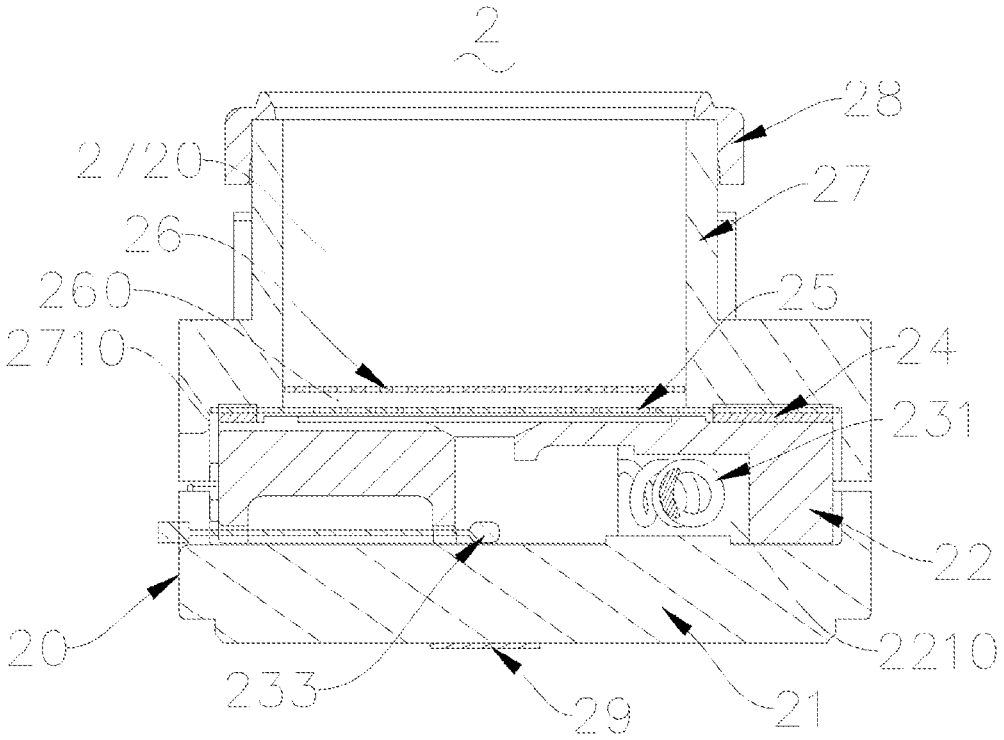
FIG. 8 is a schematic structural cross-sectional view of the heating assembly in FIG. 5.
Figure 9:
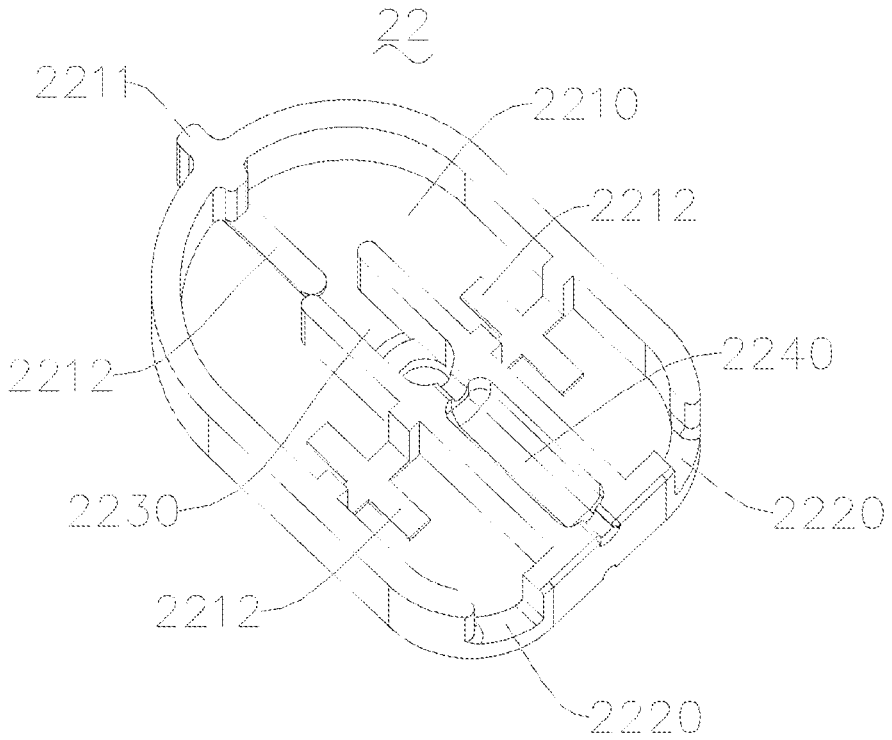
FIG. 9 is a three-dimensional schematic structural diagram a heating cover in FIG. 7.

As shown in FIG. 7 to FIG. 9, in some embodiments, the heating assembly 2 may include a heating body 20, an upper cap 27 covered on the heating body 20, and a shunt mesh 25 disposed between the heating body 20 and the upper cap 27. The heating body 20 may include a base 21, a heating cover 22 disposed on the base 21, and a heating element 231 disposed between the base 21 and the heating cover 22.

In some embodiments, the heating element 231 may be an approximately U-shaped metal heating wire. Two electrode leads 232 are respectively welded on two ends of the heating element 231, and the heating element 231 is electrically connected to the main board 15 through the two electrode leads 232. The heating cover 22 and the base 21 may be both made of a material with high temperature resistance and low thermal conductivity, and an approximately U-shaped heating cavity 2210 is formed between the heating cover 22 and the base 21. The heating element 231 is disposed in the heating cavity 2210 and heat air in the heating cavity 2210 after energized to generate heat. Side walls of the base 21 and the heating cover 22 are correspondingly provided with at least one air inlet 2220 communicating the heating cavity 2210 with the outside. In this embodiment, there are two air inlets 2220, and the two electrode leads 232 may be led out from the two air inlets 2220 respectively. It may be understood that in other embodiments, the air inlet 2220 may be alternatively only formed on the side wall of the base 21 or the heating cover 22, or the air inlet 2220 may be alternatively formed on a bottom wall of the base 21.

A convergence hole 2250 longitudinally runs through the heating cover 22, and the heating cavity 2210 surrounds the outside of the convergence hole 2250. A convergence groove 2230 communicating the heating cavity 2210 with the convergence hole 2250 is further formed between the heating cover 22 and the base 21, air introduced by the two air inlets 2220 is heated in the heating cavity 2210 by the heating element 231 to form hot air, and the hot air flows to the convergence hole 2250 after converged by the convergence groove 2230. In this embodiment, the heating cavity 2210 and the convergence groove 2230 may be both formed on a bottom of the heating cover 22, and the convergence groove 2230 may be in communication with one side of the convergence hole 2250 away from the two air inlets 2220 and extend in a length direction of the heating cover 22.

In some embodiments, the base 21 may include a plate-shaped substrate portion 211 and a circular wall portion 212 extending upward from an outer periphery of the substrate portion 211. The heating cover 22 is disposed in the wall portion 212 and may abut against the substrate portion 211. An outer wall surface of the heating cover 22 may protrude outward to form at least one thermal insulation protrusion 2211, and the heating cover 22 abuts against an inner wall surface of the wall portion 212 through the at least one thermal insulation protrusion 2211, so that direct contact thermal conduction between the outer wall surface of the heating cover 22 and the inner wall surface of the wall portion 212 may be prevented, which facilitates thermal insulation between the heating cover 22 and the base 21. An upper end surface of the substrate portion 211 may protrude outward to form at least one thermal insulation rib 2111, and a lower end of the heating element 231 abuts against and is mounted on the at least one thermal insulation rib 2111, which can greatly reduce a direct contact area between the heating element 231 and the base 21 to facilitate thermal insulation. A lower end surface of the heating cover 22 may protrude downward to form at least one thermal insulation rib 2212, and an upper end of the heating element 231 abuts against and is mounted on the at least one thermal insulation rib 2212, which can greatly reduce a direct contact area between the heating element 231 and the heating cover 22 to facilitate thermal insulation. In this embodiment, there are three thermal insulation ribs 2111 and three thermal insulation ribs 2212 respectively, which may be disposed in a one-to-one correspondence.

The shunt mesh 25 is disposed above the heating cover 22 and includes a shunt region S provided with a plurality of airflow holes 250. A diffusion cavity 2260 is formed between the heating cover 22 and the shunt mesh 25, and after the hot air flowing out from the convergence hole 2250 is diffused in the diffusion cavity 2260, the hot air is then redistributed through the plurality of airflow holes 250 on the shunt mesh 25, so that heating of the vaporization medium is more uniform. In this embodiment, the filter mesh 25 is in a shape of a flat plate and may be made of a metal material such as stainless steel. A top surface of the heating cover 22 concaves downward to form the diffusion cavity 2260, and a central axis of the diffusion cavity 2260 may overlap with a central axis of the convergence hole 2250.

The shunt region S is disposed corresponding to the diffusion cavity 2260, and a shape and an area of the shunt region S may be consistent or approximately consistent with a shape and an area of a cross section of the diffusion cavity 2260 respectively. The shunt region S may include a center region S1 located at a center and a peripheral region S2 surrounding the center region S1. A distribution density of the plurality of airflow holes 250 in the center region S1 is less than a distribution density in the peripheral region S2, to form a mesh hole structure with a sparse center and a dense periphery. The hot air flowing out from the convergence hole 2250 and diffused to the diffusion cavity 2260 may cause pressure in the center is relatively great and pressure at the periphery is related small, and the mesh hole structure is set to have a sparse center and a dense periphery, so that a flow distribution of the hot air flowing out from the airflow holes 250 in the center region S1 and the peripheral region S2 is more uniform, and the heating of the vaporization medium is more uniform. In this embodiment, the plurality of airflow holes 250 in the center region S1 are distributed at uniform intervals, and the plurality of airflow holes 250 in the peripheral region S2 are distributed at uniform intervals. In another embodiment, the distribution density of the plurality of airflow holes 250 in the shunt region S may alternatively gradually increase from the center to the periphery.

In some embodiments, the heating body 20 may further include a temperature measuring element 233 configured to measure an air temperature in the heating assembly 2. The temperature measuring element 233 generally may be a temperature sensor such as a thermal resistor. The temperature measuring element 233 may be disposed on a lower side of the heating cover 22 and configured to measure the air temperature at an entrance of the convergence hole 2250. A bottom of the heating cover 22 may form a wire groove 2240 for mounting the temperature measuring element 233, and the wire groove 2240 and the convergence groove 2230 may be respectively disposed on two opposite sides of the convergence hole 2250. In some other embodiments, the temperature measuring element 233 may be alternatively disposed on an upper side of the heating cover 22 and configured to measure the air temperature at the entrance of the convergence hole 2250, and a top of the heating cover 22 may also form a wire groove 2270 for mounting the temperature measuring element 233.

The upper cap 27 is covered on the heating cover 22 and the shunt mesh 25 and may be made of a material with high temperature resistance and low thermal conductivity such as steatite porcelain. In some embodiments, the upper cap 27 may include a first cover body 271 located at a lower portion and having a relatively large shape size and a second cover body 272 located at an upper portion and having a relatively small shape size. A bottom surface of the first cover body 271 concaves upward to form an accommodating cavity 2710, and a top surface of the second cover body 272 concaves downward to form a vaporization cavity 2720 in communication with the accommodating cavity 2710. The vaporization cavity 2720 may be configured to place a vaporization medium, and a size of a cross section of the vaporization cavity 2720 may be less than a size of a cross section of the accommodating cavity 2710. The upper portion of the heating cover 22 is disposed in the accommodating cavity 2710, and the heating cover 22 abuts against a cavity wall of the accommodating cavity 2710 through the thermal insulation protrusion 2211, to prevent direct contact thermal conduction between the outer wall surface of the heating cover 22 and an inner wall surface of the accommodating cavity 2710. The outer periphery of the shunt mesh 25 may protrude outward to form at least one limiting protrusion 251, and the shunt mesh 25 abuts against the inner wall surface of the accommodating cavity 2710 through the at least one limiting protrusion 251, which can greatly reduce a direct contact area between the shunt mesh 25 and the upper cap 27 to facilitate thermal insulation. In this embodiment, there are a plurality of limiting protrusions 251, which are distributed at intervals around the shunt mesh 25. A seal pad 24 may be further disposed between the shunt mesh 25 and the upper cap 27 and/or between the shunt mesh 25 and the heating cover 22. The seal pad 24 may be in a shape of a circular plate and may be made of an elastic material with high temperature resistance such as silica gel.

In some embodiments, the heating assembly 2 may further include a replaceable filter mesh 26 disposed above the shunt mesh 25. A vent gap 260 is formed between a bottom surface of the replaceable filter mesh 26 and a top surface of the shunt mesh 25, and a plurality of first filter holes 2610 for airflow to run through are distributed on the replaceable filter mesh 26. The replaceable filter mesh 26 may be made of a metal material with high temperature resistance such as stainless steel and configured to place solid vaporization medium such as tobacco leaves, and the replaceable filter mesh 26 is taken out after the vaporization medium is heated, which is easy to discard or easy for a user to clean and reuse the replaceable filter mesh, thereby reducing pollution to the shunt mesh 25. The replaceable filter mesh 26 is detachably disposed in the vaporization cavity 2720, and an outer edge of the replaceable filter mesh 26 may concave inward to form at least one groove 2611, so that an area of an entire cross section of the replaceable filter mesh 26 is less than an area of an entire cross section of the vaporization cavity 2720. The at least one groove 2611 may facilitate the user to take out the replaceable filter mesh 26 by using tools such as a nipper, and a contact area between the replaceable filter mesh 26 and the upper cap 27 may be reduced to facilitate thermal insulation. In this embodiment, there are a plurality of grooves 2611, which are distributed at intervals around the replaceable filter mesh 26.

In this embodiment, the replaceable filter mesh 26 may be in a shape of a flat plate, and a shape and a size of the replaceable filter mesh may be consistent or approximately consistent with a shape and a size of the shunt region S of the shunt mesh 25 respectively. The replaceable filter mesh 26 includes a first region A1 located at a center and a second region A2 surrounding the first region A1. The first region A1 and the second region A2 are disposed corresponding to the center region S1 and the peripheral region S2 respectively, and a distribution density of the plurality of first filter holes 2610 in the first region A1 is less than a distribution density in the second region A2, to form a mesh hole structure with a sparse center and a dense periphery, so that a flow distribution of the hot air is more uniform and the heating of the vaporization medium is more uniform. In this embodiment, the plurality of first filter holes 2610 in the first region A1 are distributed at uniform intervals, and the plurality of first filter holes 2610 in the second region A2 are distributed at uniform intervals. In another embodiment, the distribution density of the plurality of first filter holes 2610 on the replaceable filter mesh 26 may alternatively gradually increase from a center to a periphery.

In some embodiments, the heating assembly 2 may further include a seal ring 28 sleeved on the second cover body 272 and a locking member 29 configured to lock the upper cap 27 and the base 21. The seal ring 28 may be in a shape of a circle and may be made of an elastic material with high temperature resistance such as silica gel. The locking member 29 may be made of a metal material with high temperature resistance such as stainless steel. The locking member 29 is in a shape of a square ring provided with an opening on one side and may include a bottom wall 291 and two L-shaped clamp arms 292 respectively extending upward from two ends of the bottom wall 291. The locking member 29 surrounds the base 21 and the first cover body 271, to lock the upper cap 27 and the base 21.

Figure 10:
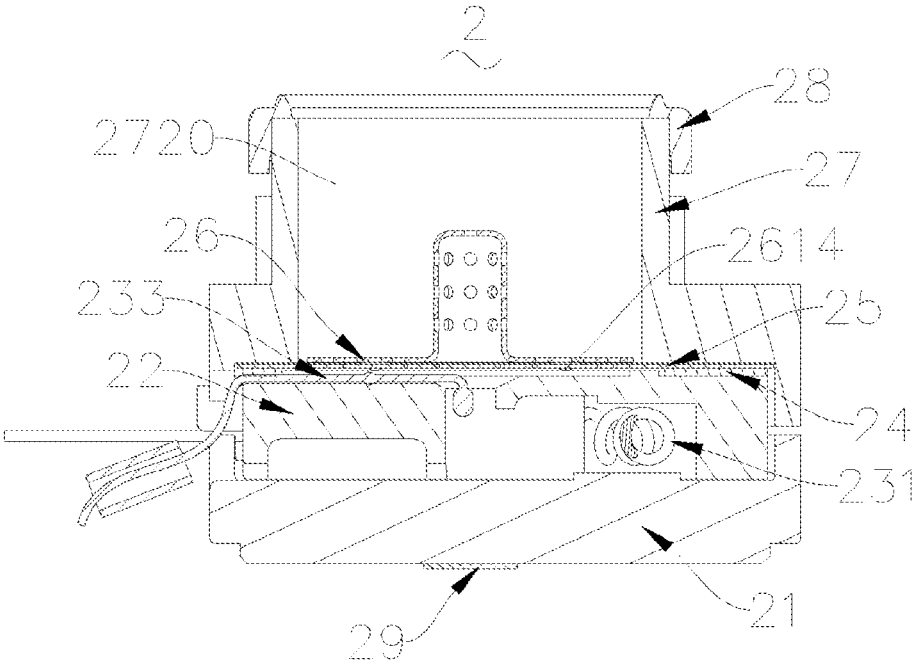
FIG. 10 is a schematic structural cross-sectional view of a heating assembly of a vaporization device according to a second embodiment of the present disclosure.
Figure 11:
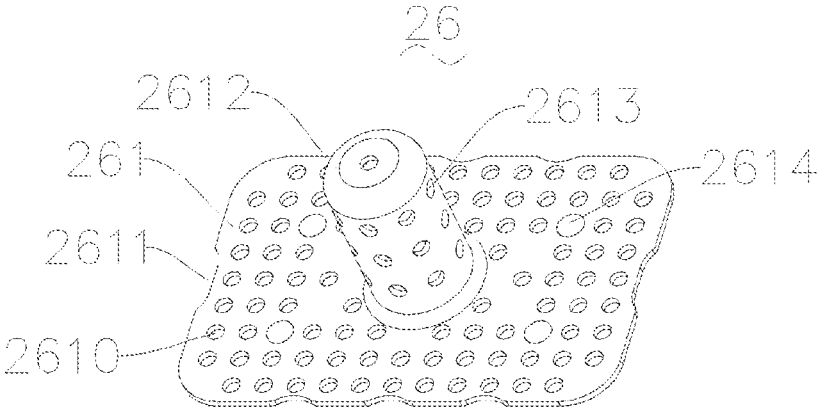
FIG. 11 is a three-dimensional schematic structural diagram of a replaceable filter mesh in FIG. 10.

FIG. 10 to FIG. 11 show a heating assembly 2 in a second embodiment of the present disclosure, and a main difference between the second embodiment and the first embodiment lies in that, in this embodiment, the temperature measuring element 233 is disposed on an upper side of the heating cover 22 and configured to measure an air temperature at the entrance of the convergence hole 2250. In addition, the replaceable filter mesh 26 in this embodiment may include a flat plate-shaped bottom wall 261 and a cylindrical protruding portion 2612 extending upward from the bottom wall 261. A plurality of first filter holes 2610 are distributed on the bottom wall 261, a distribution of the plurality of first filter holes 2610 on the bottom wall 261 is similar to the distribution of the flat plate-shaped replaceable filter mesh 26 in the first embodiment, and details are not described herein again. An outer edge of the bottom wall 261 concaves inward to form at least one groove 2611, which facilitates the user to take out the replaceable filter mesh 26 by using tools such as a nipper, and a contact area between the replaceable filter mesh 26 and the upper cap 27 may be reduced to facilitate thermal insulation. A bottom surface of the bottom wall 261 may further protrude downward to form at least one bump 2614, and the replaceable filter mesh 26 may abut against the shunt mesh 25 through the bump 2614. In this embodiment, there are four bumps 2614, which are respectively located at four corners of the protruding portion 2612.

The protruding portion 2612 is in a shape of an inverted hollow cylinder, and a side wall and a top wall of the protruding portion are respectively provided with a plurality of second filter holes 2613 for airflow to run through. The hot air may flow into the vaporization cavity 2720 through the plurality of second filter holes 2613, to increase a contact area with the vaporization medium, so that the heating and vaporization are more uniform.

Figure 12:
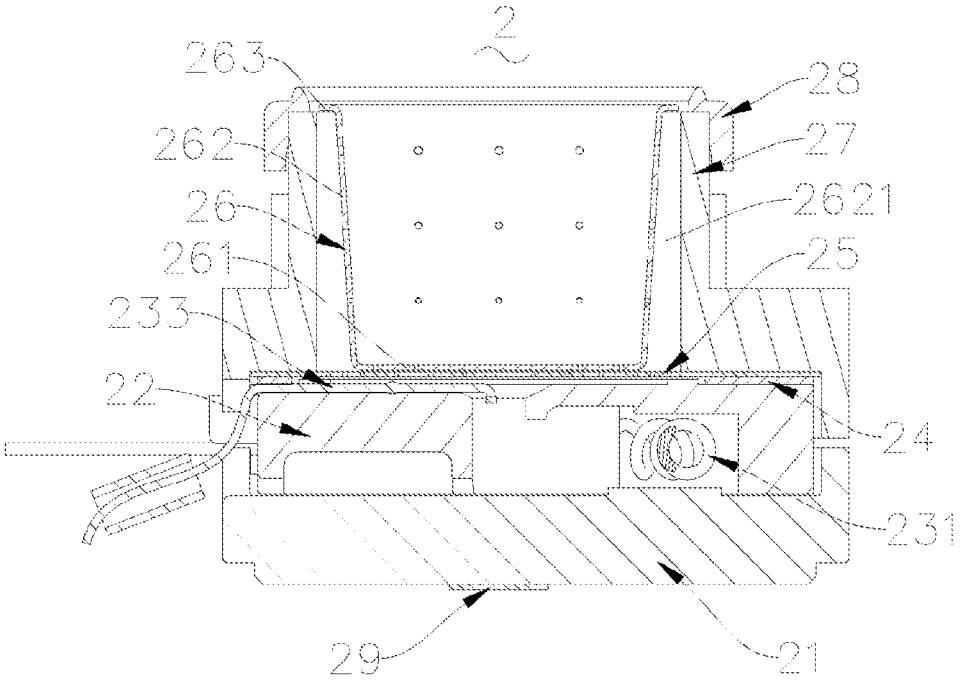
FIG. 12 is a schematic structural cross-sectional view of a heating assembly of a vaporization device according to a third embodiment of the present disclosure.
Figure 13:
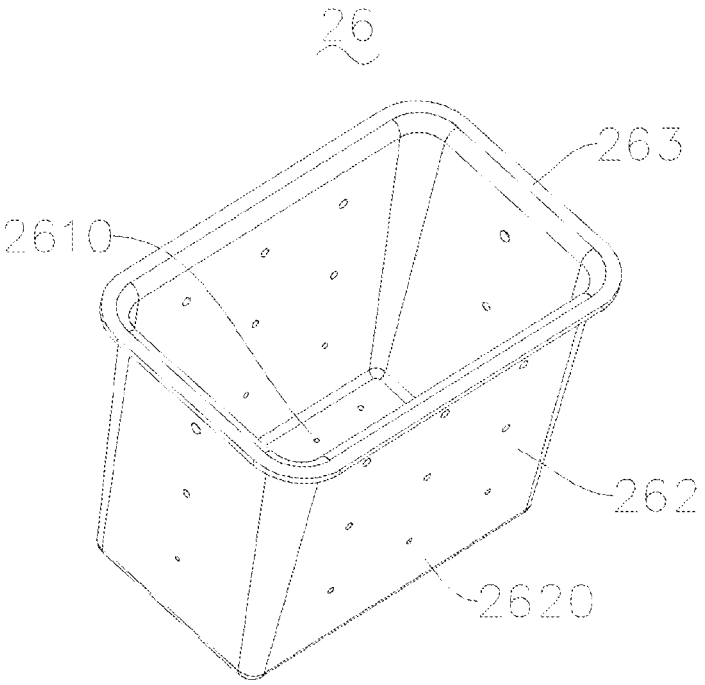
FIG. 13 is a three-dimensional schematic structural diagram of a replaceable filter mesh in FIG. 12.

FIG. 12 to FIG. 13 show a heating assembly 2 in a third embodiment of the present disclosure, and a main difference between the second embodiment and the first embodiment lies in that, in this embodiment, the temperature measuring element 233 is disposed on an upper side of the heating cover 22 and configured to measure an air temperature at the entrance of the convergence hole 2250. In addition, the replaceable filter mesh 26 in this embodiment is in a shape of a bowl and may include a flat plate-shaped bottom wall 261, a cylindrical side wall 262 extending upward from an outer periphery of the bottom wall 261, and a circular flange 263 extending outward from an upper periphery of the cylindrical side wall 262. A plurality of first filter holes 2610 are distributed on the bottom wall 261, a distribution of the plurality of first filter holes 2610 on the bottom wall 261 is similar to the distribution of the flat plate-shaped replaceable filter mesh 26 in the first embodiment, and details are not described herein again. The flange 263 may abut against the upper end surface of the heating cover 22, to facilitate mounting and positioning of the replaceable filter mesh 26 in the vaporization cavity 2720.

The cylindrical side wall 262 may be approximately in a shape of a funnel and a size of a cross section thereof decreases from top to bottom. A plurality of third filter holes 2620 for airflow to run through are distributed on the cylindrical side wall 262, and an airflow gap 2621 is formed between the cylindrical side wall 262 and the inner wall surface of the vaporization cavity 2720, so that the hot air may flow into the vaporization cavity 2720 through the airflow gap 2621 and the third filter holes 2620 sequentially, to make the heating and vaporization more uniform. In addition, the cylindrical side wall 262 is not in contact with the upper cap 27, which facilitates thermal insulation between the replaceable filter mesh 26 and the upper cap 27.

Figure 14:
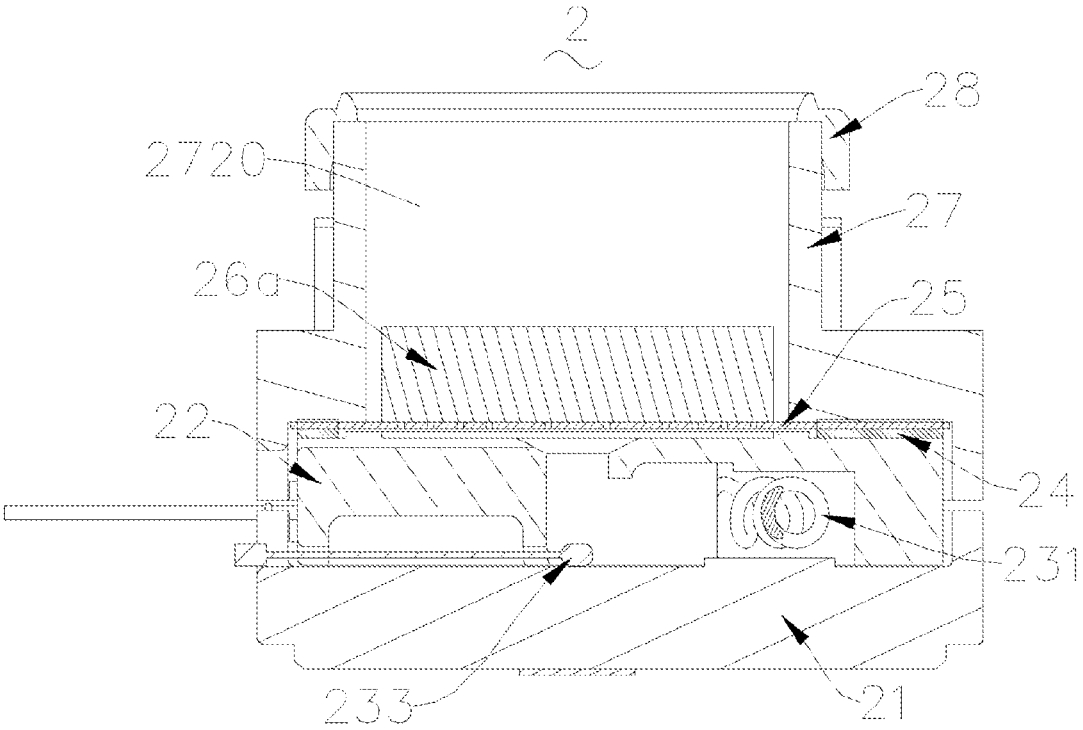
FIG. 14 is a schematic structural cross-sectional view of a heating assembly of a vaporization device according to a fourth embodiment of the present disclosure.

FIG. 14 shows a heating assembly 2 in a fourth embodiment of the present disclosure, and a main difference between the fourth embodiment and the first embodiment lies in that, in this embodiment, the heating assembly 2 further includes a paste guide body **26*a* disposed above the shunt mesh 25 and configured to place a paste vaporization medium, so that the replaceable filter mesh 26 is not required. The paste guide body 26*a* may use an absorbing structure with a capillary adsorption function, so that after the paste vaporization medium is heated and melted, the melted liquid is absorbed and prevented from flowing to the shunt mesh 25**.

It may be understood that, the foregoing technical features may be combined and used freely without limitation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A suction nozzle assembly, comprising:

a suction nozzle base provided with an air guide channel and a suction nozzle rotatably mounted on the suction nozzle base, the suction nozzle comprising a rotation shaft portion and a suction nozzle portion transversely extending from the rotation shaft portion, a rotation central axis of the rotation shaft portion being disposed in a biased manner relative to a central axis of the suction nozzle base and a central axis of the suction nozzle portion respectively, the suction nozzle portion forming an air suction channel communicating the air guide channel with outside air, and the air suction channel comprising an air suction end away from the rotation shaft portion, wherein the suction nozzle portion is configured to transversely rotate around the rotation shaft portion, in a plane parallel to a mounting plane at a top position of the suction nozzle base, between a first position and a second position relative to the suction nozzle base, wherein, when the air suction channel is at the second position, the air suction end of the air suction channel protrudes out of the suction nozzle base, wherein the suction nozzle base comprises the mounting plane configured to mount the suction nozzle portion, wherein the air guide channel comprises a first air guide channel extending in a direction upward from a bottom surface of the suction nozzle base, a third air guide channel extending downward from the mounting plane in a bias manner relative to a central axis of the first air guide channel, and a second air guide channel communicating the first air guide channel with the third air guide channel, wherein the rotation shaft portion is rotatably disposed in the third air guide channel, and wherein a clasp member is detachably clamped on the rotation shaft portion so as to define an axial position of the rotation shaft portion in the third air guide channel.

2. The suction nozzle assembly of claim 1, wherein, when the air suction channel is at the first position, the air suction end of the air suction channel is configured to be retracted into the suction nozzle base.

3. The suction nozzle assembly of claim 1, wherein, when the air suction channel is at the second position, a position of the air suction end of the air suction channel is higher than a position of the suction nozzle base.

4. The suction nozzle assembly of claim 1, wherein the suction nozzle is detachably mounted on the suction nozzle base.

5. The suction nozzle assembly of claim 1, wherein the air suction channel extends in a length direction of the suction nozzle portion.

6. The suction nozzle assembly of claim 1, wherein a fasten groove is formed on the rotation shaft portion, wherein the clasp member comprises an opening ring, and wherein the opening ring is detachably clamped in the fasten groove and clamped between a lower end surface of the third air guide channel and a lower end surface of the fasten groove.

7. The suction nozzle assembly of claim 6, wherein the clasp member further comprises an extending portion extending from one side of the opening ring away from the rotation shaft portion.

8. The suction nozzle assembly of claim 1, further comprising:

a filter mesh disposed in the first air guide channel; and a plurality of filter holes for airflow to run through, the plurality of filter holes being distributed on the filter mesh.

9. A vaporization device, comprising:

a body; and the suction nozzle assembly of claim 1, the suction nozzle assembly being disposed in the body.

10. The vaporization device of claim 9, wherein the suction nozzle assembly is detachably disposed on the body.

11. The vaporization device of claim 9, further comprising:

a heating assembly disposed in the body and in air communication with the air guide channel, the heating assembly comprising a heating body and a shunt mesh disposed on the heating body.

12. The vaporization device of claim 11, wherein a convergence hole is formed on the heating body, wherein a diffusion cavity communicating the convergence hole with the air guide channel is formed between the heating body and the shunt mesh, wherein the shunt mesh comprises a shunt region disposed corresponding to the diffusion cavity, and wherein a plurality of airflow holes for airflow to run through are distributed on the shunt region.

13. The vaporization device of claim 12, wherein the shunt region comprises a center region located at a center and a peripheral region surrounding the center region, and wherein a distribution density of the plurality of airflow holes in the center region is less than a distribution density of the plurality of airflow holes in the peripheral region.

14. The vaporization device of claim 11, wherein the heating assembly further comprises a replaceable filter mesh disposed above the shunt mesh and configured to place a vaporization medium, and wherein the replaceable filter mesh comprises a bottom wall, and wherein a plurality of first filter holes for airflow to run through are distributed on the bottom wall.

15. The vaporization device of claim 14, wherein the replaceable filter mesh comprises a first region located at a center and a second region surrounding the first region, and wherein a distribution density of the plurality of first filter holes in the first region is less than a distribution density of the plurality of first filter holes in the second region.

16. The vaporization device of claim 14, wherein a vent gap is formed between the replaceable filter mesh and the shunt mesh.

17. The vaporization device of claim 11, wherein the heating assembly further comprises a paste guide body disposed above the shunt mesh and configured to place a paste vaporization medium.

18. A suction nozzle assembly, comprising:

a suction nozzle base provided with an air guide channel and a suction nozzle rotatably mounted on the suction nozzle base, the suction nozzle comprising a rotation shaft portion and a suction nozzle portion transversely extending from the rotation shaft portion, a rotation central axis of the rotation shaft portion being disposed in a biased manner relative to a central axis of the suction nozzle base and a central axis of the suction nozzle portion respectively, the suction nozzle portion forming an air suction channel communicating the air guide channel with outside air, and the air suction channel comprising an air suction end away from the rotation shaft portion, wherein the suction nozzle portion is configured to transversely rotate around the rotation shaft portion, in a plane parallel to a mounting plane at a top position of the suction nozzle base, between a first position and a second position relative to the suction nozzle base, wherein, when the air suction channel is at the second position, the air suction end of the air suction channel protrudes out of the suction nozzle base, wherein the suction nozzle base comprises the mounting plane configured to mount the suction nozzle portion, wherein the air guide channel comprises a first air guide channel extending upward from a bottom surface of the suction nozzle base, a third air guide channel extending downward from the mounting plane in a bias manner relative to a central axis of the first air guide channel, and a second air guide channel communicating the first air guide channel with the third air guide channel, and wherein the rotation shaft portion is rotatably disposed in the third air guide channel.

19. A suction nozzle assembly, comprising:

a suction nozzle base provided with an air guide channel and a suction nozzle rotatably mounted on the suction nozzle base, the suction nozzle comprising a rotation shaft portion and a suction nozzle portion transversely extending from the rotation shaft portion, a rotation central axis of the rotation shaft portion being disposed in a biased manner relative to a central axis of the suction nozzle base and a central axis of the suction nozzle portion respectively, wherein the rotation shaft portion includes an airflow channel, the suction nozzle portion forming an air suction channel communicating the air guide channel with outside air via the airflow channel, and the air suction channel comprising an air suction end away from the rotation shaft portion, wherein the suction nozzle portion is configured to transversely rotate around the rotation shaft portion, in a plane parallel to a mounting plane at a top position of the suction nozzle base, between a first position and a second position relative to the suction nozzle base, wherein, when the air suction channel is at the second position, the air suction end of the air suction channel protrudes out of the suction nozzle base, wherein the suction nozzle base comprises the mounting plane configured to mount the suction nozzle portion, wherein the air guide channel comprises a first air guide channel extending upward from a bottom surface of the suction nozzle base, a third air guide channel formed through downward extension of the mounting plane in a bias manner relative to a central axis of the first air guide channel, and a second air guide channel communicating the first air guide channel with the third air guide channel, wherein the rotation shaft portion is rotatably disposed in the third air guide channel, and wherein a clasp member is detachably clamped on the rotation shaft portion so as to define an axial position of the rotation shaft portion in the third air guide channel.

20. The suction nozzle assembly of claim 19, wherein the airflow channel is disposed coaxially with the third air guide channel.

* * * * *